United States Patent [19]

Yoshikado et al.

[11] Patent Number: 5,055,885

[45] Date of Patent: Oct. 8, 1991

[54] PICTURE IMAGE FORMING EQUIPMENT

[75] Inventors: Shouji Yoshikado; Masami Kawada; Hidekazu Amamoto; Atsuna Saiki; Kiyoyuki Endo; Yutaka Inasaki, all of Saitama, Japan

[73] Assignee: Fuji Xerox Co., Ltd., Tokyo, Japan

[21] Appl. No.: 599,150

[22] Filed: Oct. 17, 1990

[30] Foreign Application Priority Data

Nov. 9, 1989 [JP] Japan ..... 1-291568

[51] Int. Cl.[5] ..... G03G 15/00

[52] U.S. Cl. ..... 355/318; 355/309; 355/24; 271/186; 271/229

[58] Field of Search ..... 355/318, 319, 321, 309, 355/308, 24, 26, 23; 271/3.1, 185, 186, 226, 229

[56] References Cited

U.S. PATENT DOCUMENTS 4,806,979 2/1989 Tokoro et al. ..... 355/24 X
4,918,490 4/1990 Stemmle ..... 355/318
4,979,727 12/1990 Koike et al. ..... 271/186 X

*Primary Examiner*—R. L. Moses
*Attorney, Agent, or Firm*—Finnegan, Henderson, Farabow, Garrett, and Dunner

[57] ABSTRACT

A paper path for guiding and transporting sheets of paper in an image former such as a printer or a photocopier which forms an image on both sides of the sheet of paper. The paper path has three channels: an image forming channel, a paper discharging channel, and a paper reversing channel. At the point where all three channels merge, a paper gate is provided for both guiding sheets of paper and signaling the presence of paper at the point where the three channels merge. The top surface of a paper tray containing unused sheets of paper is part of the paper reversing channel. When paper passes over the top surface of the paper tray, a roller momentarily stops the motion of the paper to prevent skew. A claw connected to the paper tray separates paper with an image formed on one side from paper in the tray. Guides provided over the claw prevent paper jams. A clutch is connected between one of the paper rollers and a driving source, and the clutch selectively disconnects the driving source to stop the motion of the paper to prevent skew. A second claw is provided on one of the paper rollers to ensure that only one sheet of paper enters the roller at a time. The second claw prevents paper jams which occur when two sheets of paper stick together by the force of static electricity.

16 Claims, 14 Drawing Sheets

PICTURE IMAGE FORMING EQUIPMENT

BACKGROUND OF THE INVENTION

1. Field of the Invention

The present invention relates to picture image forming equipment using an electrostatic image recording process, such as copying machines, facsimile machines, and printers. The present invention is an improvement on such picture image forming equipment designed to form images on both sides of sheets of paper.

2. Description of the Prior Art

FIG. 18 presents a conceptual drawing illustrating a conventional picture image former 1 applied to a printer. The picture image former 1 performs duplex printing, in which picture images are formed on both sides of the paper. An exposing unit 4 is housed inside the main unit 2 of the picture image former 1. The exposing unit 4 converts image information into an on-off signal for a laser beam and irradiates the laser beam onto a photosensitive unit 3, form electrostatic latent images on the surface of the photosensitive unit 3. A developing unit is arranged on one side of the photosensitive unit 3 and is not illustrated in the FIG. 18. A fixing unit 5 fixes the developed images by applying heat.

A paper transporting channel, in the main unit of the picture image former 1, guides and transports the paper, and is indicated by the dotted line in FIG. 18. The paper transporting channel is composed of an image forming channel A, a paper discharging channel B, and a paper reversing channel C. The three channels A, B, and C merge at a point D to form a connection. The image forming channel A and the paper reversing channel C also merge to form a second connection. The channels are part of separate component parts of the picture image former 1 to be described later. The individual channels A, B, and C are provided with a number of paper transporting rollers set along the channels.

The paper transporting rollers will now be described. A feeding roller 8, having a semicircular sectional shape, draws out one sheet of paper 6 at a time from a paper cassette 7 which contains a number of sheets of paper 6, and transports the sheet of paper 6 into the image forming channel A. An intermediate roller 10 transports the sheet of paper 6 to a registering roller 9. Another intermediate roller 11 transports the sheet paper 6 discharged from the fixing unit 5, and a transporting roller 12 transports the sheet paper 6 discharged from the intermediate roller 11 to the paper discharging channel B. A discharging roller 14 discharges the paper from the paper discharging channel 13 to a paper discharge tray 13. Finally, a transporting roller 15, rotating in the opposite direction from the paper discharging channel B, transports the paper into the paper reversing channel C to the feeding roller 8.

The image former 1 contains an exfoliating corotron 16.

A spring 17 in the paper cassette 7 constantly applies an upward thrust to a plate 18 under the paper 6 to load the paper in the uppermost part of the paper cassette 7 in constant pressurized contact with a separating claw 19.

The operation of the picture image former 1 will now be described.

A duplex image is formed on a sheet of paper a having an upper face b, a lower face e, a fore (heading) edge c, and a rear (trailing) edge d.

As shown in FIG. 19, in which the same parts are represented by the same references marks as those in FIG. 18, when the feeding roller 8 rotates, the sheet of paper a, indicated by a solid line, is moved out of the paper cassette 7. The sheet of paper a is transferred to the image forming channel A, and then the intermediate roller 10 transports the sheet of paper a to the registering roller 9. As illustrated in FIG. 20, images are formed and fixed on the upper face b of the paper a by the photosensitive unit 3 and the fixing unit 5 while the paper a passes through the image forming channel A. Subsequently, the intermediate roller 11 and the transporting roller 12 transport the paper a with an image formed on its upper face b to the paper discharging channel B.

The paper a is then moved into the paper discharging channel B. The paper discharging roller 14, arranged at the downstream end of the paper discharging channel B, discharges the paper a into the inside area of the paper discharge tray 13, as shown in FIG. 21. The paper a is then transported back into the paper discharging channel B with the rear edge d of the paper a set in the forward position, as shown in FIG. 22. The paper discharging roller 14 rotates in reverse to transport the paper a into the reversing channel C, as shown in FIG. 23. As shown in FIG. 24, the transporting roller 15 transports the paper a over the cover *7a* of the paper cassette 7 to a position where it is taken up by the feeding roller 8.

The feeding roller 8 is then driven a second time to transport the paper a with an image formed on its upper face b into the image forming channel A for a second time, as shown in FIG. 25. The paper a is then transported by the intermediate roller 10 to the registering roller 9. Images are formed and fixed on the lower face e of the paper a by the photosensitive unit 3 and the fixing unit 5, as shown in FIG. 26. The intermediate roller Il and the transporting roller 12 convey the paper a with images formed on the lower face e to the paper discharging channel B.

The paper a is then transported toward the side of the paper discharge tray 13 by the discharging roller 14 arranged at the downstream end of the paper discharging channel B, as shown in FIG. 27. Finally, the paper a is discharged to the paper discharge tray 13 as shown in FIG. 28.

By this series of steps, images are formed on both faces b and e of the paper a, and the sheets of paper with duplex images are stacked up in the paper discharge tray 13.

The picture image former 1 described above is provided with a gate which opens and closes the image forming channel A. The gate is positioned at the point D, where the three paper transporting channels, the image forming channel A, the paper discharging channel B, and the paper reversing channel C, merge to form a junction. The gate guides the paper a moving in the reverse direction through the paper discharging channel B, as shown in FIG. 22, into the paper reversing channel C.

An actuator for a paper detecting sensor is also provided at the point D to control the timing of the actuation of the paper discharging roller 14 through detection of the paper a as it approaches the point D.

Therefore, the picture image former 1 has a large number of component parts, including a gate and an actuator for a sensor comprised of independent component parts and separately installed at the point D.

In the picture image former 1 described above, accurate formation of an image on the lower face e of the paper a requires passing the paper a through the paper reversing channel C without skew. The conventional picture image former 1 cannot accurately form images on the lower face e of the paper a. Paper skew occurs when the fore edge c runs against the separating claw 19 of the paper cassette 7 while the paper a moving in reverse is guided over the cover *7a* of the paper cassette 7.

In the duplex picture image former 1, the discharging roller 14 must rotate in reverse to form images on both faces of the paper. When many sheets of paper are stacked up in the paper discharge tray 13, the equipment is susceptible to paper jams resulting from capture of the paper by the discharging roller 14 out of the paper discharging tray 13. Jamming is more likely when sheets of paper in the paper discharge tray 13 stick together because of static electricity.

SUMMARY OF THE INVENTION

An object of the present invention is to reduce the number of component parts in a duplex imager at the point where the image forming channel, the paper discharging channel, and the paper reversing channel merge.

An additional object of the present invention is to prevent skew of the paper in a duplex imager as it passes over the paper cassette.

A further object of the present invention is to prevent the paper in a duplex imager placed in the paper discharge tray from being pulled into the discharging roller when the roller rotates in reverse.

Additional objects and advantages of the invention will be set forth in part in the description which follows and in part will be obvious from the description, or may be learned by practice of the invention. The objects and advantages of the invention may be realized and attained by means of the instrumentalities and combinations particularly pointed out in the appended claims.

To achieve the objects of the invention a paper path for guiding and transporting a sheet of paper in an image former which forms an image on both sides of the sheet of paper is provided. The paper path comprises an image forming channel having a first paper roller for transporting a sheet of paper past the image former; a paper discharging channel connected at a first connecting point to the image forming channel and having a second paper roller arranged to rotate in a forward and a reverse direction for transporting a sheet of paper between the first connecting point and a discharge tray; and a paper reversing channel connected to the first connecting point and connected at a second connecting point to the image forming channel having a third roller for transporting a sheet of paper from the first connecting point to the second connecting point. A paper gate at the first connecting print guides a sheet of paper at the first connecting point and signals the presence of the sheet of paper at the first connecting point.

The paper reversing channel also comprises a paper tray containing paper having a top surface over which paper travels; a claw on the paper tray for separating paper in the tray and paper traveling over the top surface of the tray; and a guide for guiding paper over the claw.

A clutch engages the third roller for selectively driving and stopping the third roller. The clutch stops the roller once while a sheet of paper is in the paper reversing channel.

The paper is stopped once while it is moving over the top surface of the paper tray.

The second roller has a claw fixed on the side of the second roller extending beyond the second roller.

BRIEF DESCRIPTION OF THE DRAWINGS

The accompanying drawings, which are incorporated in and constitute a part of this specification, illustrate embodiments of the invention and, together with the description, serve to explain the principles of the invention. In the drawings.

DETAILED DESCRIPTION OF THE PREFERRED EMBODIMENTS

Figure 1:
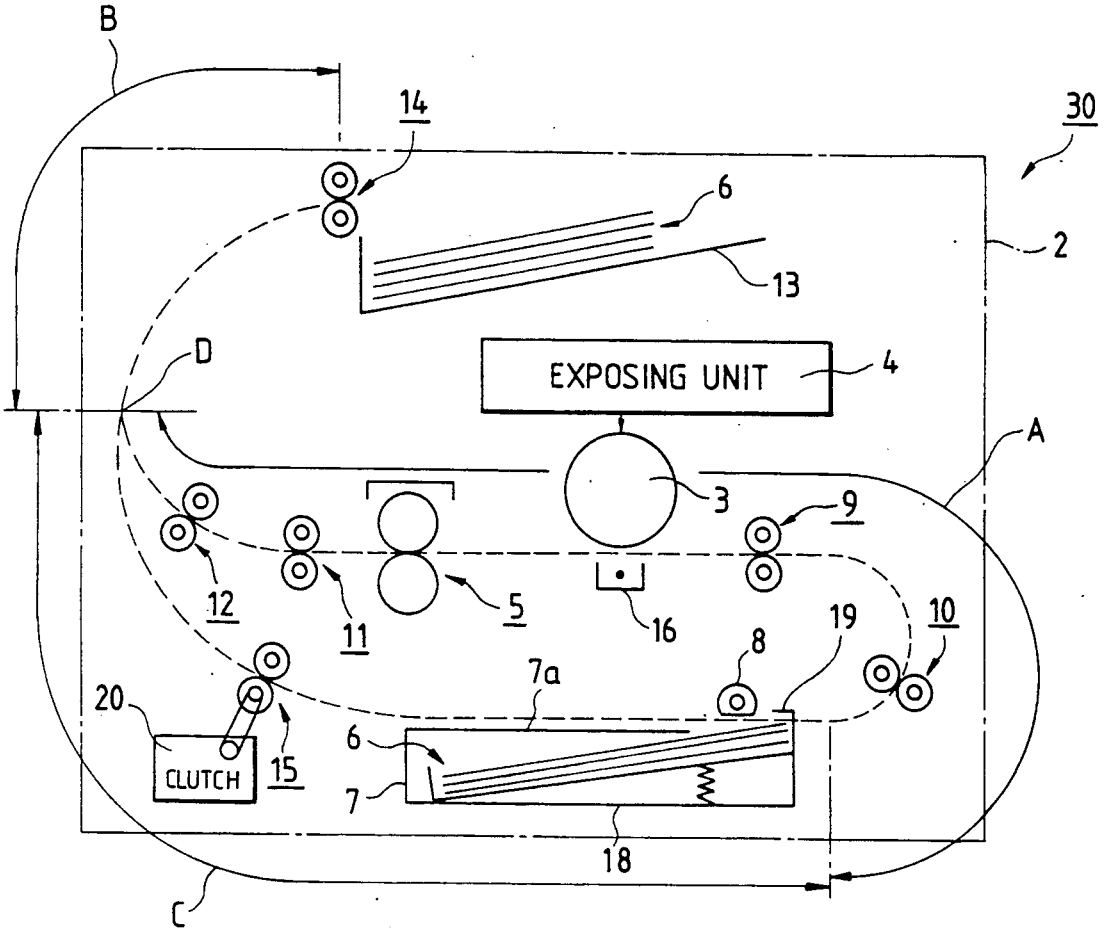
FIG. 1 presents a conceptual drawing of the picture image forming equipment according to the present invention.

In a duplex printer, photocopier or other type of imager, a gate is installed at the junction of the three paper transporting channels. The gate is designed to both control the direction of the paper and to function as an actuator for the paper sensor. Therefore, it is not necessary to install an actuator for a paper detecting sensor as an independent component part at the junction of the paper transporting channels, and a reduction in the number of the component parts is achieved.

A clutch is arranged at the driving roller side of a pair of transporting rollers, which transport the paper to the feeding roller. The paper is stopped once at the transporting rollers by the action of the clutch to insure a proper alignment of the paper's fore edge. The proper alignment will correct any skew which has occurred.

An inclined area is provided around the separating claw set in the paper cassette. Therefore, paper which has moved past the cover of the paper cassette and is being transported to the separating claw is guided along the inclined area to the upper surface of the separating claw without running against the separating claw.

A strip or sheet is placed on the separating claw set on the paper cassette to cover the separating claw. Therefore, the paper which has moved past the cover of the paper cassette and is being transported to the separating claw is guided along the sheet to the upper area of the separating claw without running against the separating claw.

The feeding roller holds the paper, which has passed over the cover of the paper cassette and is being transported to the separating claw, before the paper runs against the separating claw. Therefore, when the paper is transported for the second time by the feeding roller, the paper will not be susceptible to skew even if the paper runs against the separating claw.

A claw on a side of the discharging roller rotates in the forward direction and in the reverse direction. The claw protrudes from the circumferential area of the discharging roller and is set at a prescribed angle of inclination toward the paper discharge tray. Therefore, even if a sheet of paper, placed inside the paper discharge tray, is pulled together with the paper in the reverse direction towards the discharging roll, the paper pulled out of the tray will come into contact with the claw and will be prevented from intruding into the discharging roll.

Reference will now be made in detail to the construction according to the present invention as illustrated in the accompanying drawings, in which like reference characters designate like or corresponding parts throughout the several figures.

Figure 18:
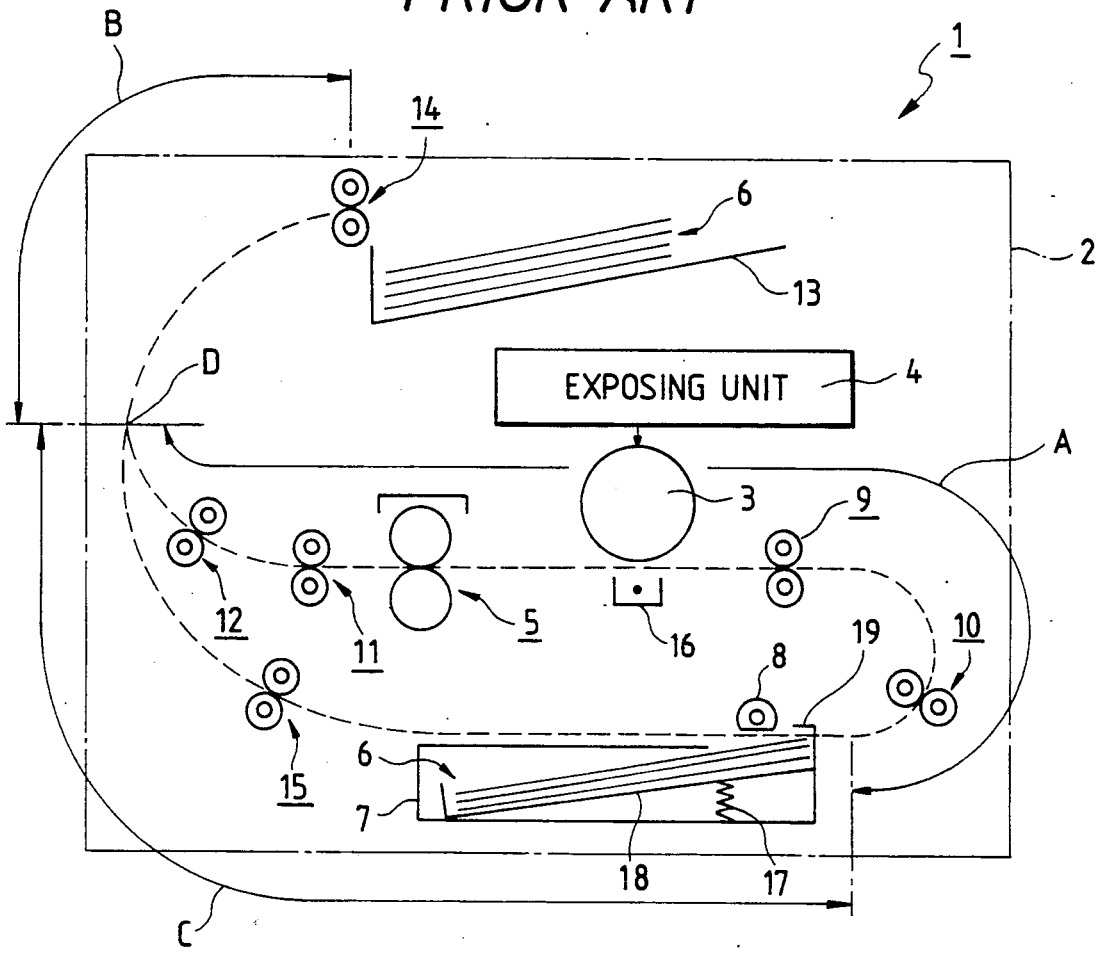
FIG. 18 PRIOR ART
FIG. 18 is a conceptual drawing of the conventional picture image forming equipment.
Figure 19:
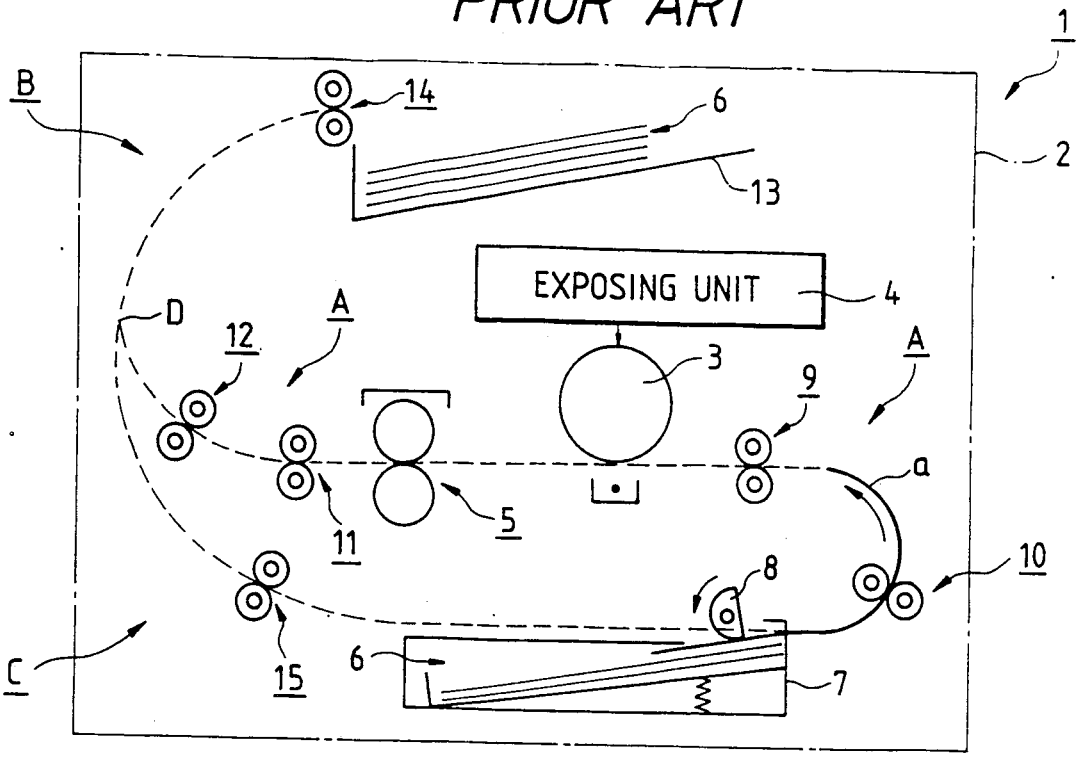
FIG. 19 PRIOR ART
FIGS. 19–28 are conceptual drawings showing the operation of the conventional picture image forming equipment shown in FIG. 18.
Figure 20:
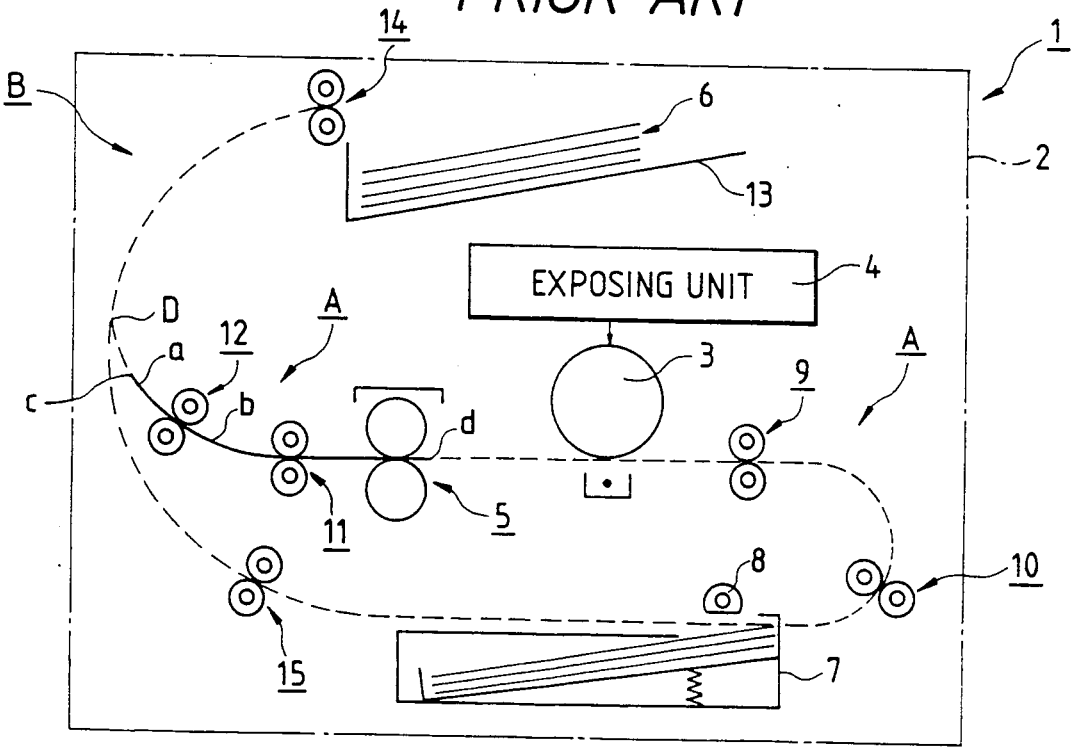
FIG. 20 PRIOR ART
Figure 21:
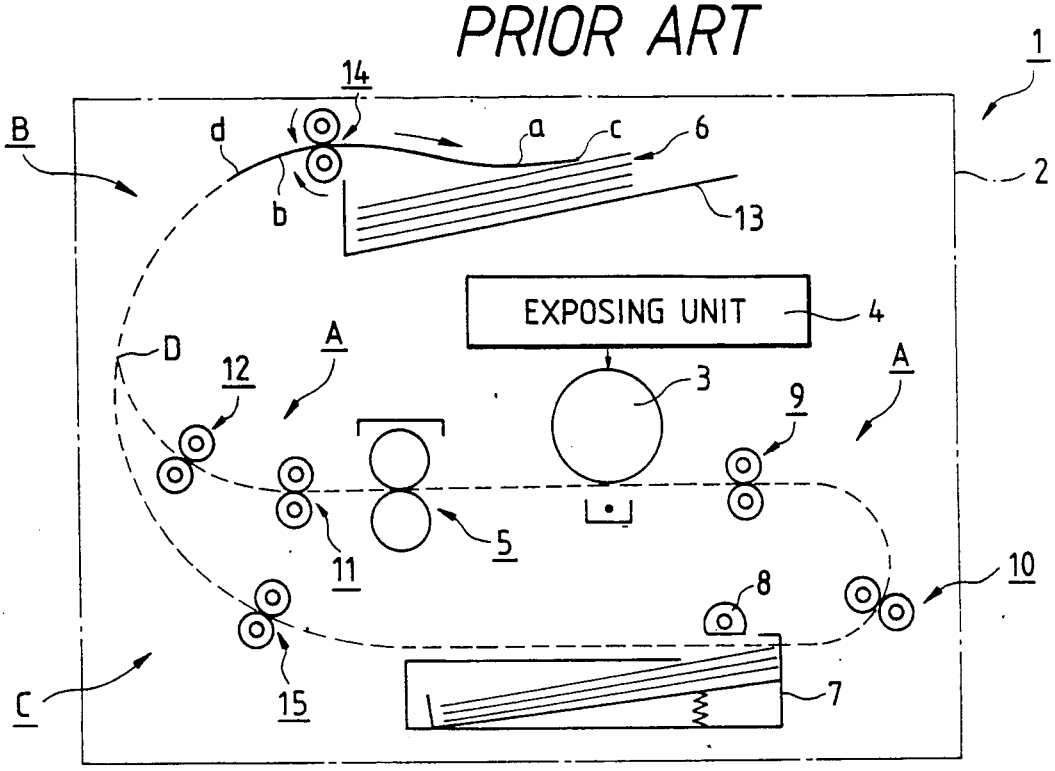
FIG. 21 PRIOR ART
Figure 22:
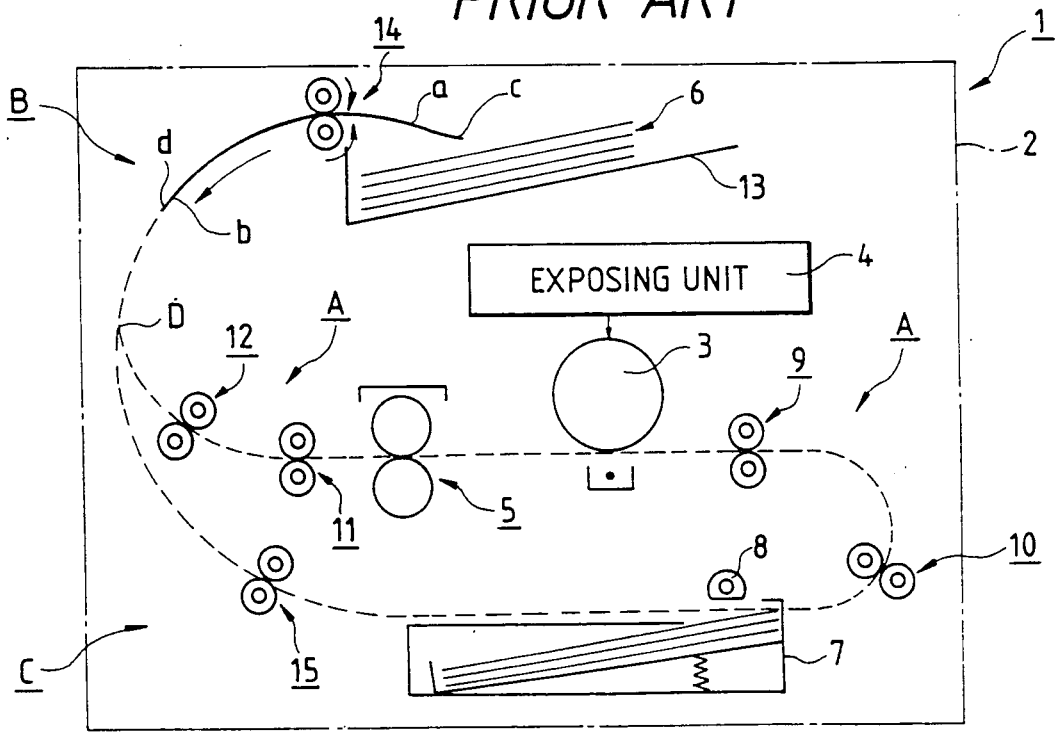
FIG. 22 PRIOR ART
Figure 23:
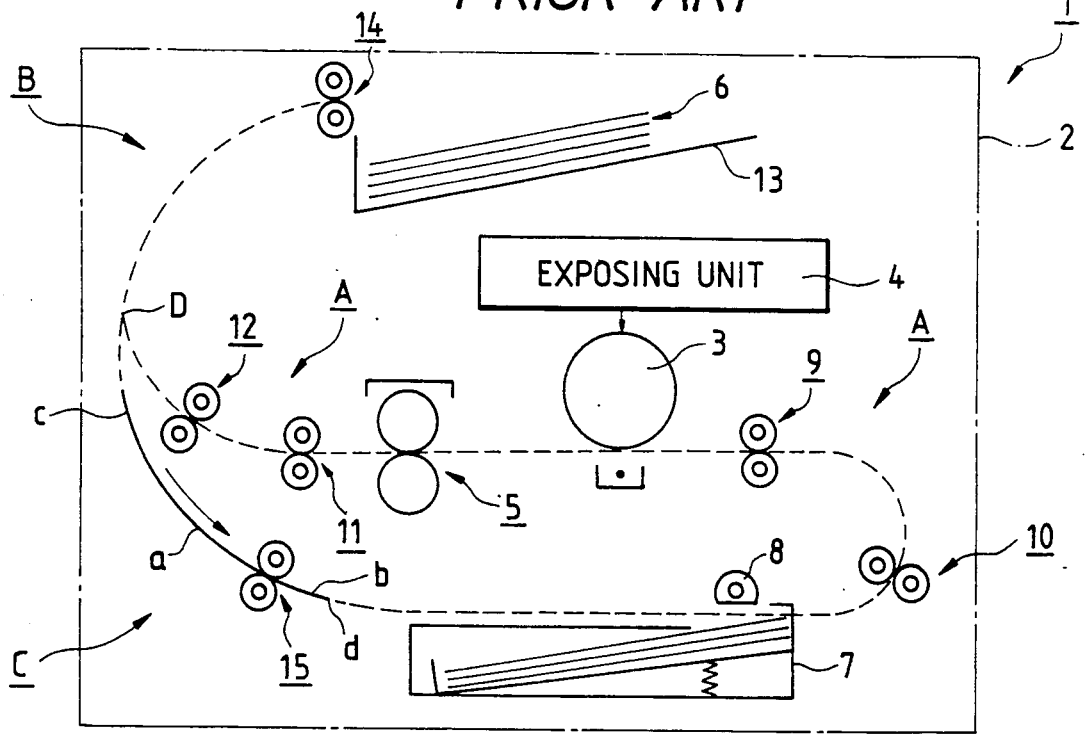
FIG. 23 PRIOR ART
Figure 24:
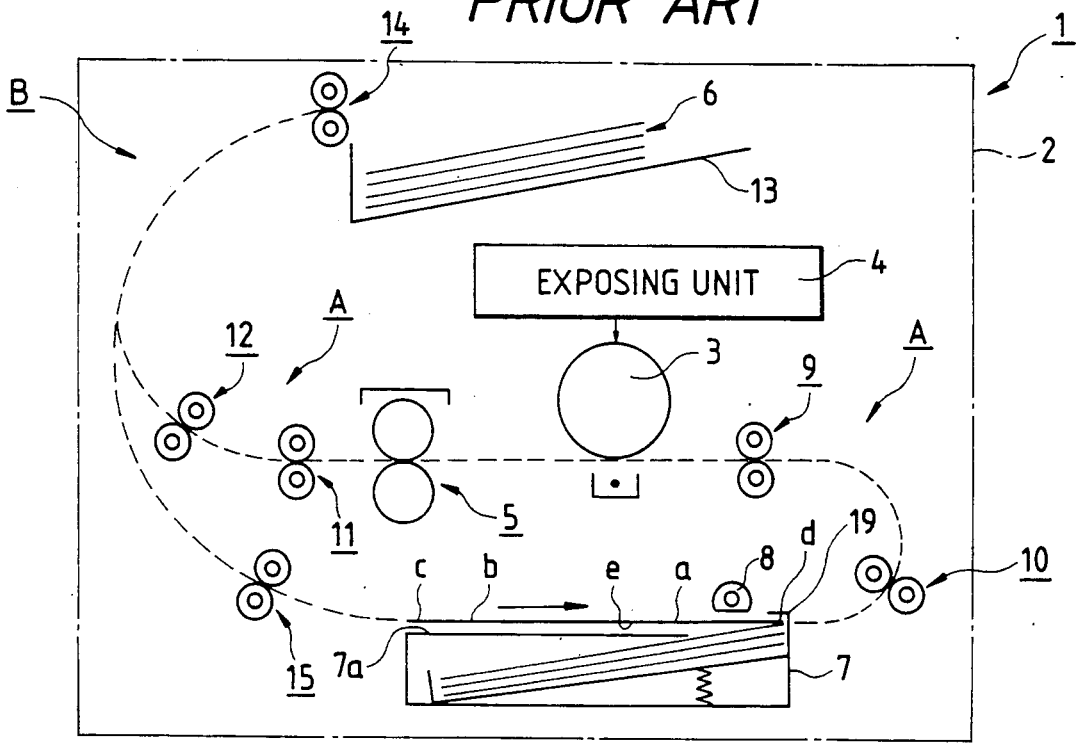
FIG. 24 PRIOR ART
Figure 25:
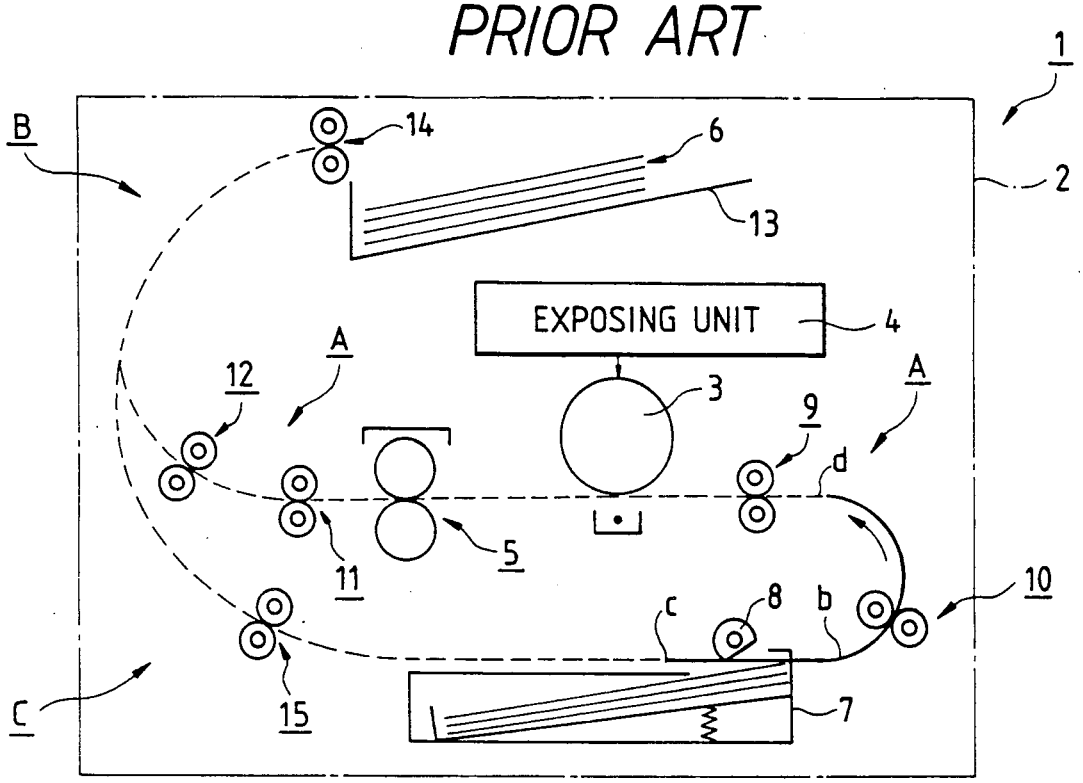
FIG. 25 PRIOR ART
Figure 26:
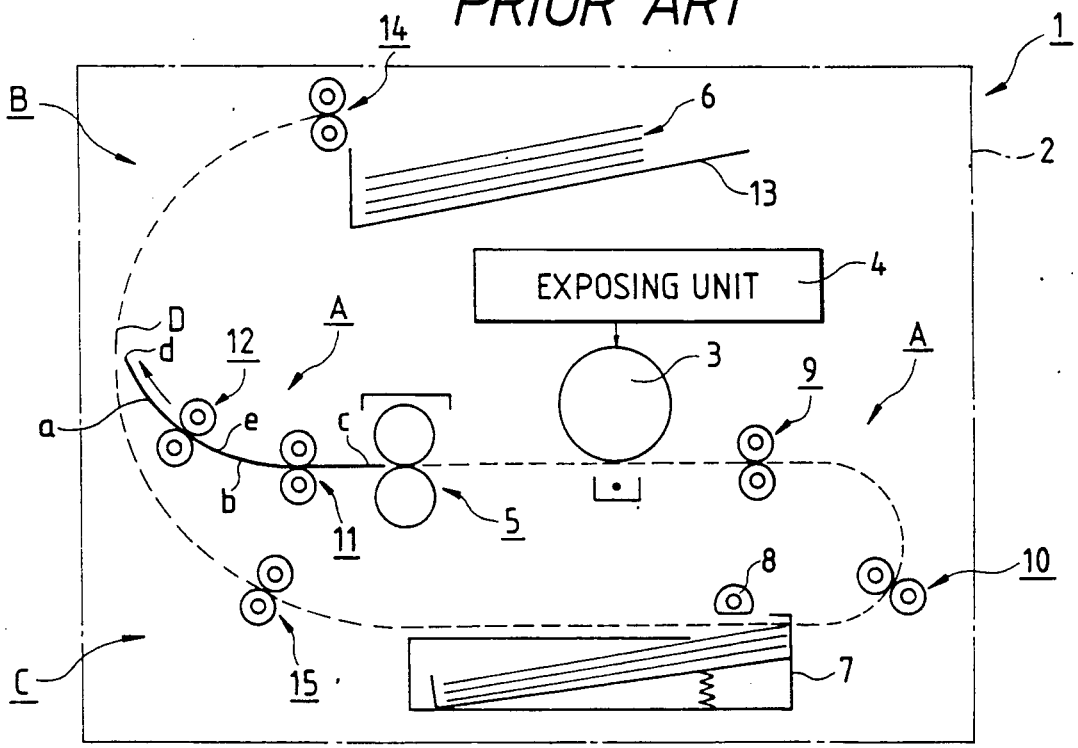
FIG. 26 PRIOR ART
Figure 27:
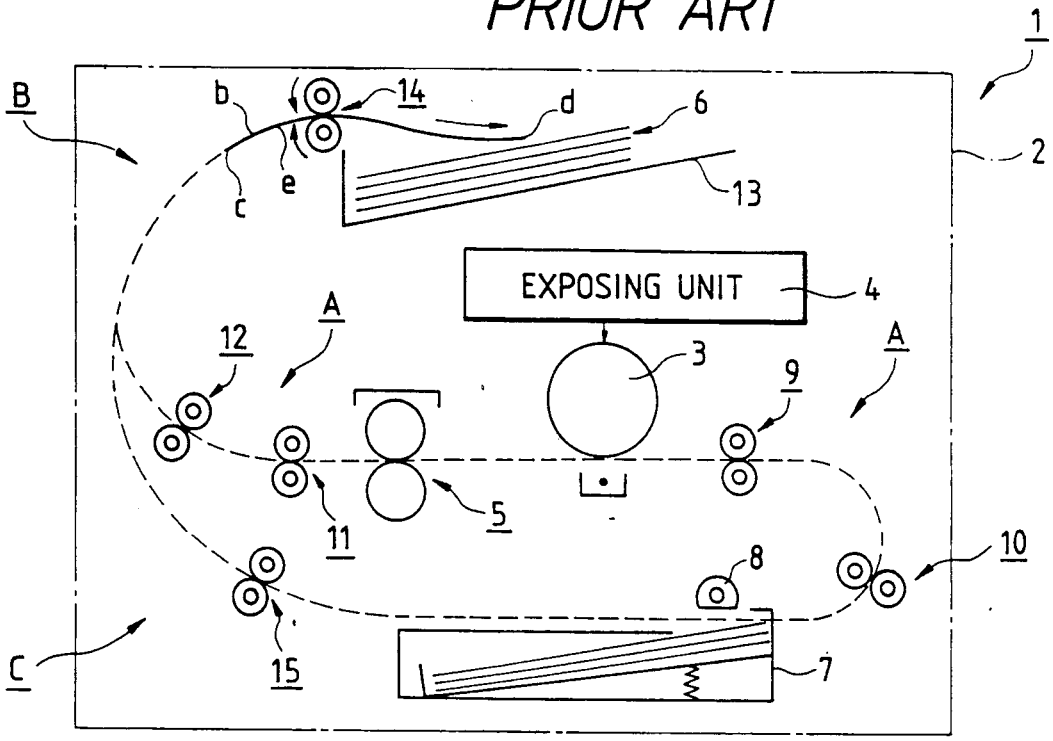
FIG. 27 PRIOR ART
Figure 28:
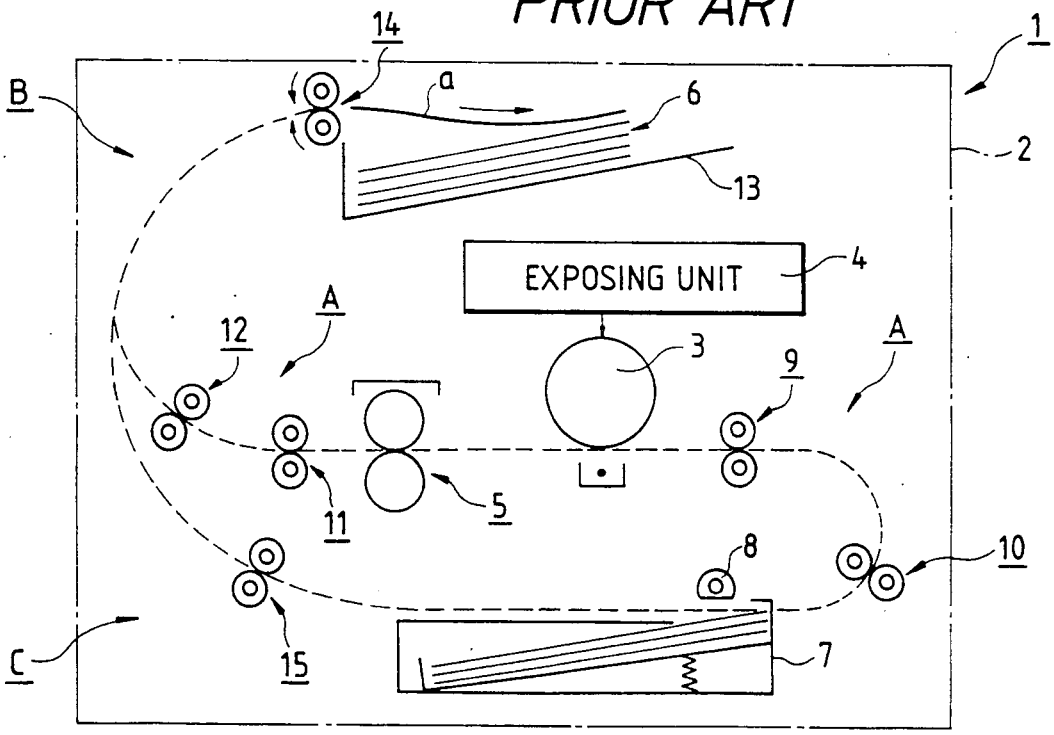
FIG. 28 PRIOR ART

FIG. 1 is a conceptual drawing illustrating a picture image former 30 according to the present invention and indicates the component parts identical to those shown in FIG. 18 with the same reference marks.

Figure 2:
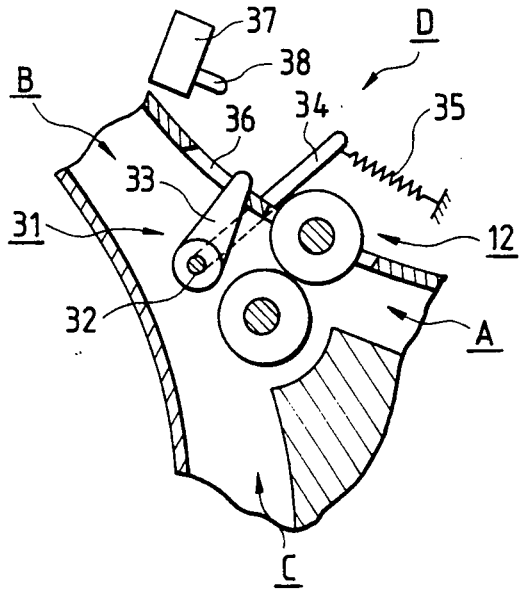
FIGS. 2–4 illustrate, on a magnified scale, parts of the equipment shown in FIG. 1.
Figure 3:
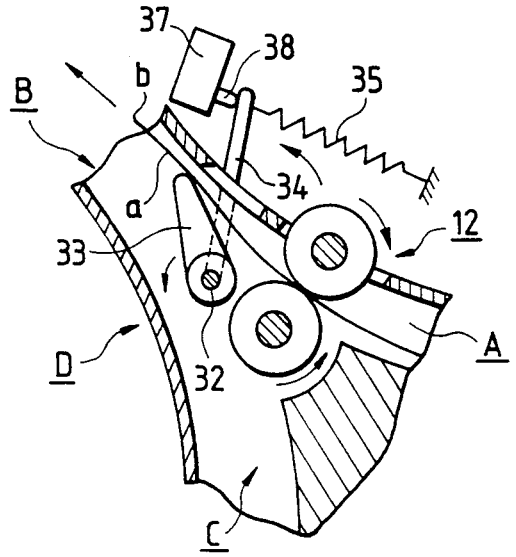

In the picture image former 30, a gate 31, which also works as an actuator for a paper detecting sensor, is arranged as shown in FIG. 2. The gate 31 is located at the point D, where the image forming channel A, the paper discharging channel B, and the paper reversing channel C merge. The gate 31 is comprised of a lever 33 fixed on one end of a rotating shaft 32, and an arm 34 rigidly fixed on the other end of the rotating shaft 32. A spring 35 biases the arm 34 in a clockwise direction. The lever 33 rigidly fixed on the shaft 32 rotates in a clockwise direction through a prescribed angle, along with the rotating motion of the shaft 32. Lever 33 normally closes the image forming channel A.

The lever 33 ordinarily protrudes outside of the paper transporting channels through a notch 36. The lever 33 is suspended on one end of the notch 36, and, thus, cannot rotate in a clockwise direction beyond a prescribed angle.

A microswitch 37 works as a paper detecting sensor, while an operating rod 38 controls the on-off operation of the microswitch 37.

The working and construction of the gate 31 will now be described.

The transporting roller 12, moves the paper a, past the image forming channel A and into the paper discharging channel B. The fore edge b of the paper a contacts the lever 33, and, with the impetus of the motion, rotates the lever 33 in a counterclockwise direction against the biasing force applied by the spring 35 With this rotating motion, the arm 34 rigidly fixed on the shaft 32 also rotates in a counterclockwise direction. When the arm 34 has rotated through the prescribed angle, the arm 34 pushes the operating rod 38 of the microswitch 37 turning on the contact in the microswitch 37.

Figure 4:
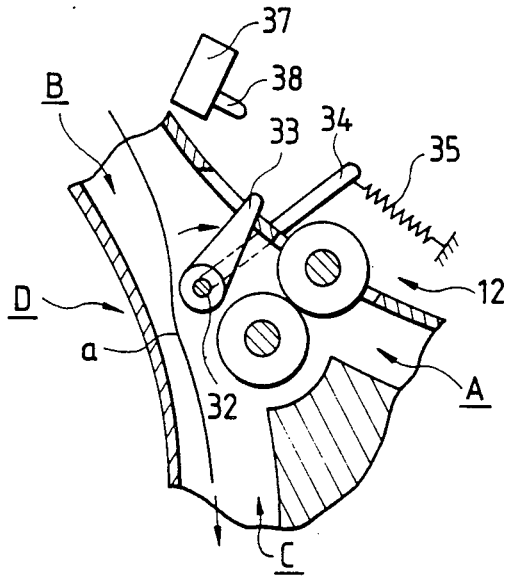
Figure 5:
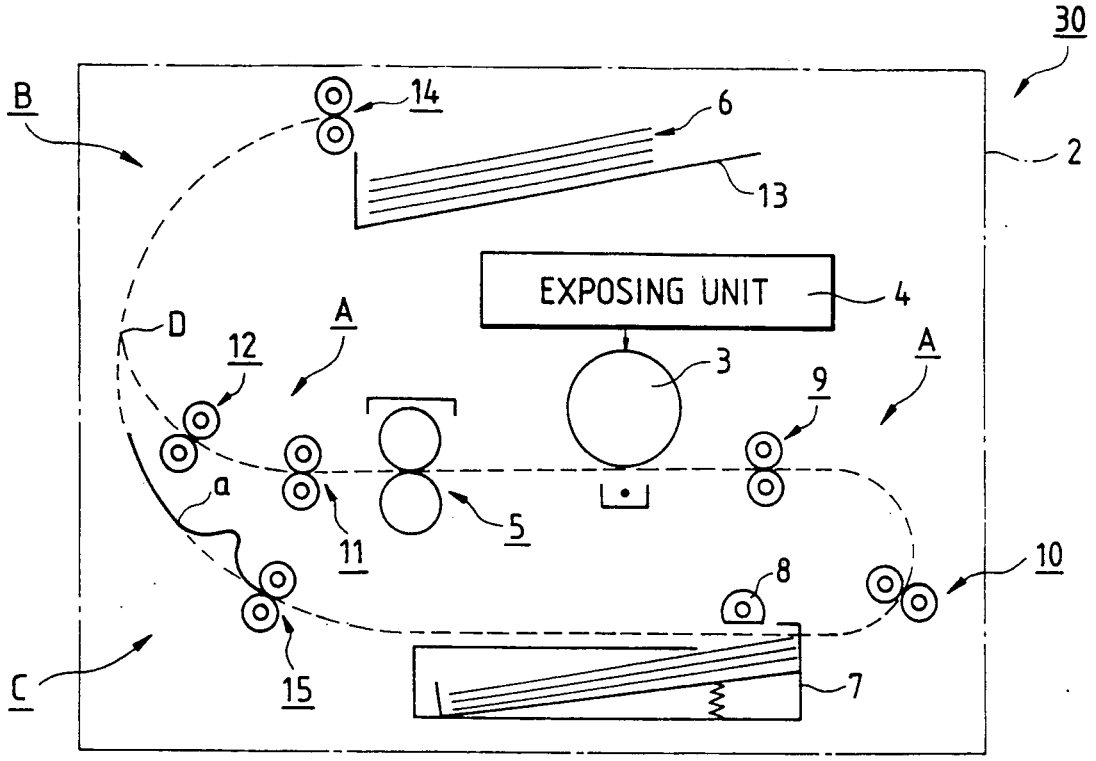
FIGS. 5–8 are conceptual drawings illustrating the operation of the picture image forming equipment shown in FIG. 1.
Figure 6:
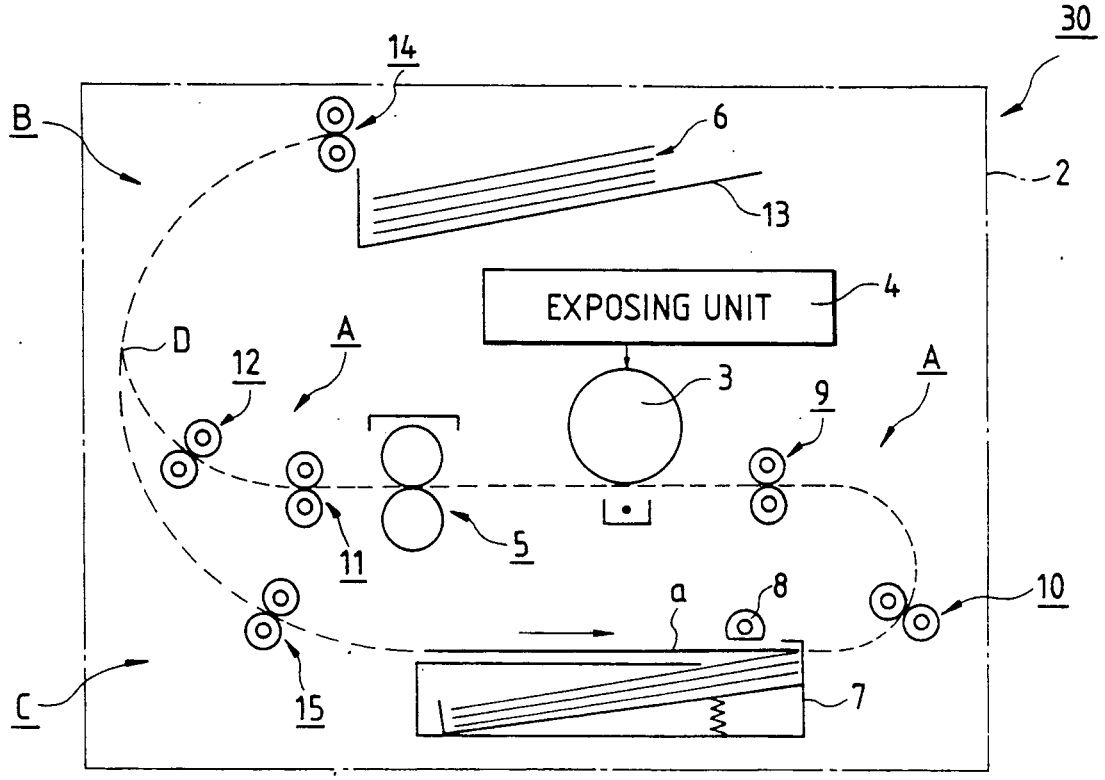

When the paper a moves in reverse in the paper discharging channel B, as indicated by the arrow in FIG. 4, the biasing force applied by the spring 35 rotates through a prescribed angle in a clockwise direction. The lever 33, thus, closes the image forming channel A, and the paper a is guided, unfailingly, into the paper reversing channel C without entering the image forming channel A. As the arm 34 has rotated in a clockwise direction at the same time, the pressure applied by the arm 34 to the operating rod 38 of the microswitch 37 is released, and the contact in the microswitch 37 is turned off.

With the gate 31 described above; the opening and closing operations of the lever 33 serve to perform the combined operating functions of opening and closing the gate and operating the microswitch 37. Therefore, an independent actuator for the paper sensor at the point D is not necessary, and the number of component parts installed at the point D is reduced.

Referring to FIG. 1, the picture image former 30 mentioned above is provided with a clutch 20 which connects and disconnects motor power to the driving roller of the transporting roller 15.

The clutch 20 is connected to the driving roller of the transporting rollers 15, which transport the paper to the feeding roller 8 arranged on the terminal side of the paper reversing channel C. The rotation of the transporting rollers 15 is stopped once by releasing the connection of the clutch. Paper skew is corrected by the effect of a loop formed on the paper a as the fore edge c of the paper a runs against the suspended transporting rollers 15. Even if paper skew has occurred while the paper a passes through the paper reversing channel C and the paper a is transported in its normal posture to the position where it is to be nipped by the feeding roller 8, stopping the transporting rollers 15 will straighten the skew.

Figure 7:
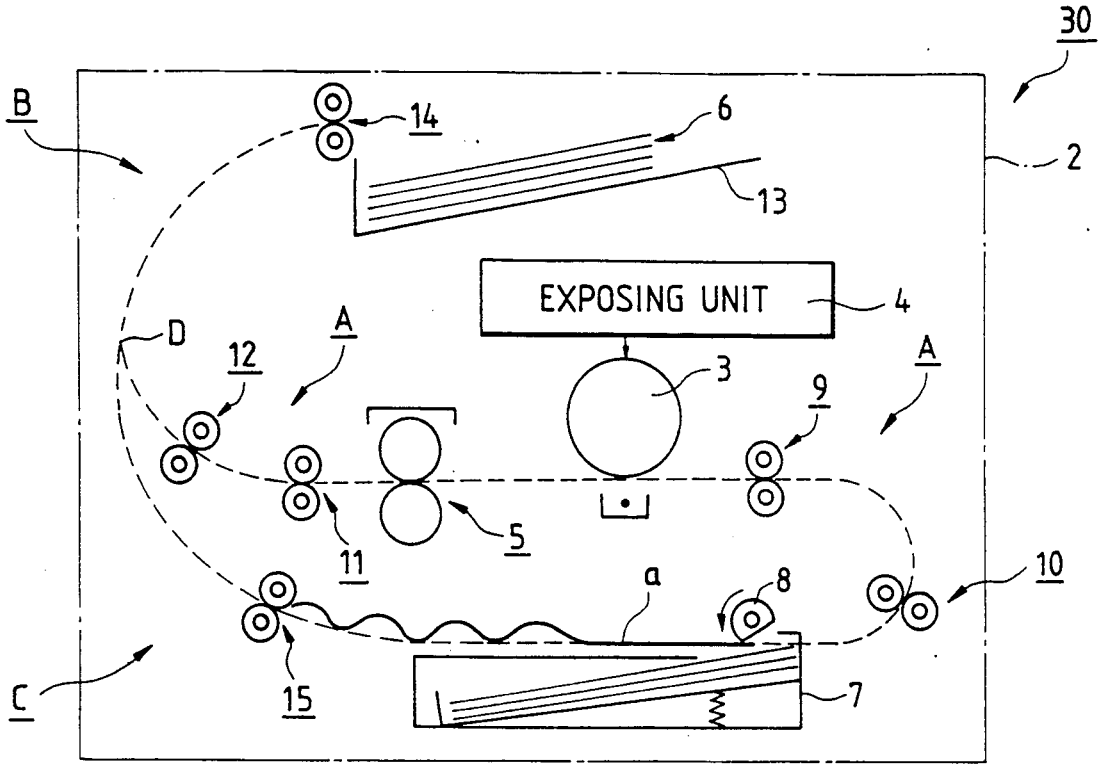
Figure 8:
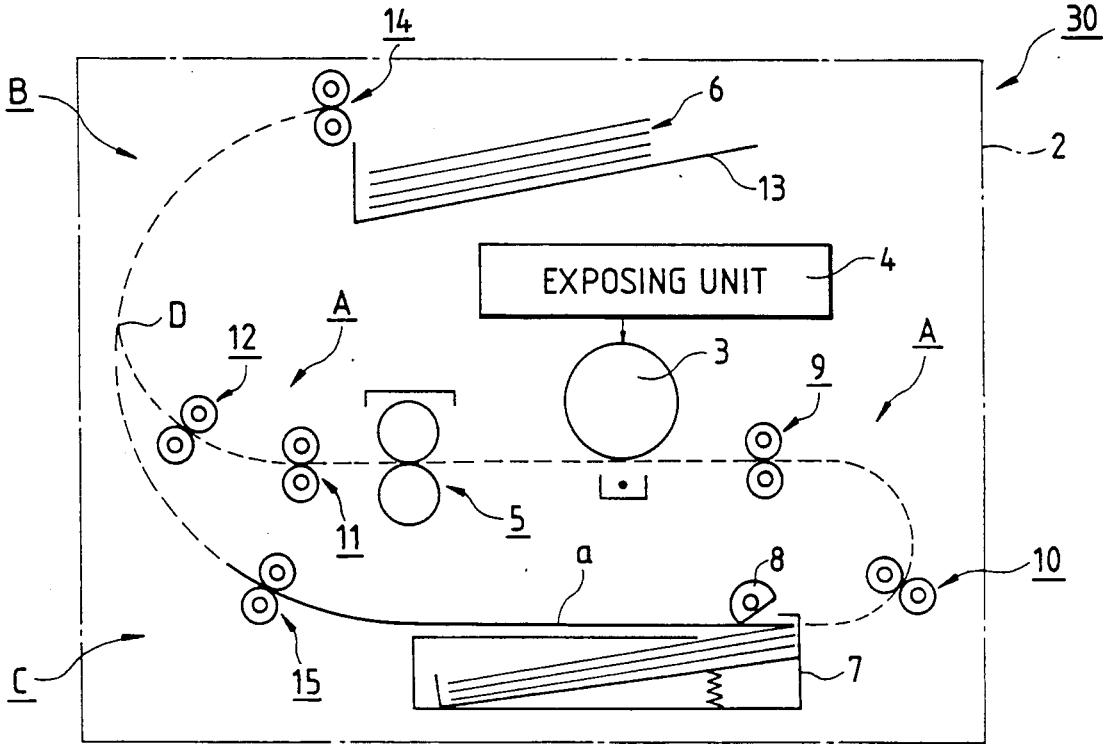

If the paper transporting speed of the feeding rollers 8 is slower than that of the transporting rollers 15, or if the feeding roller 8 stops the paper a which passes through the paper reversing channel C, the transporting force of the transporting rollers 15 tends to cause corrugation (wrinkles) in the rear part of the paper a, as shown in FIG. 7. However, the rear part of the paper a will not be susceptible to corrugation because the transporting rollers 15 do not pressure the rear edge of the paper a after the connection of the clutch is released.

Figure 9:
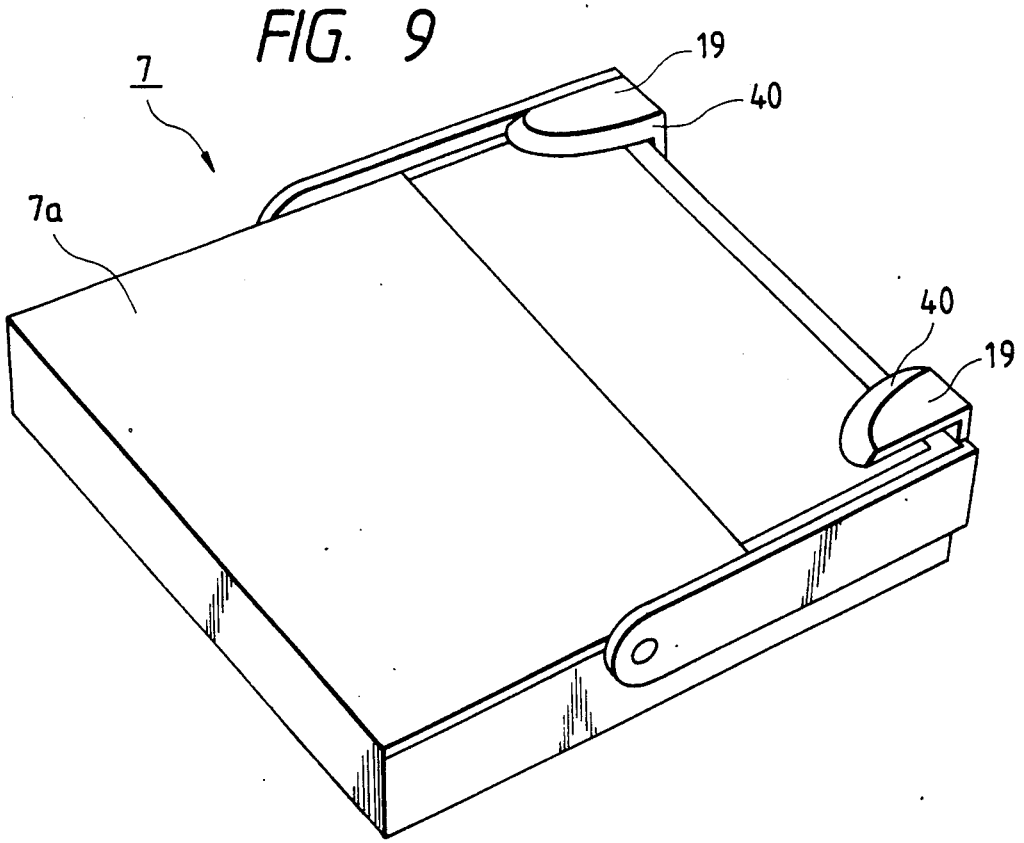
FIGS. 9–12 are perspective views showing, on a magnified scale, part of the equipment shown in FIG. 1.
Figure 10:
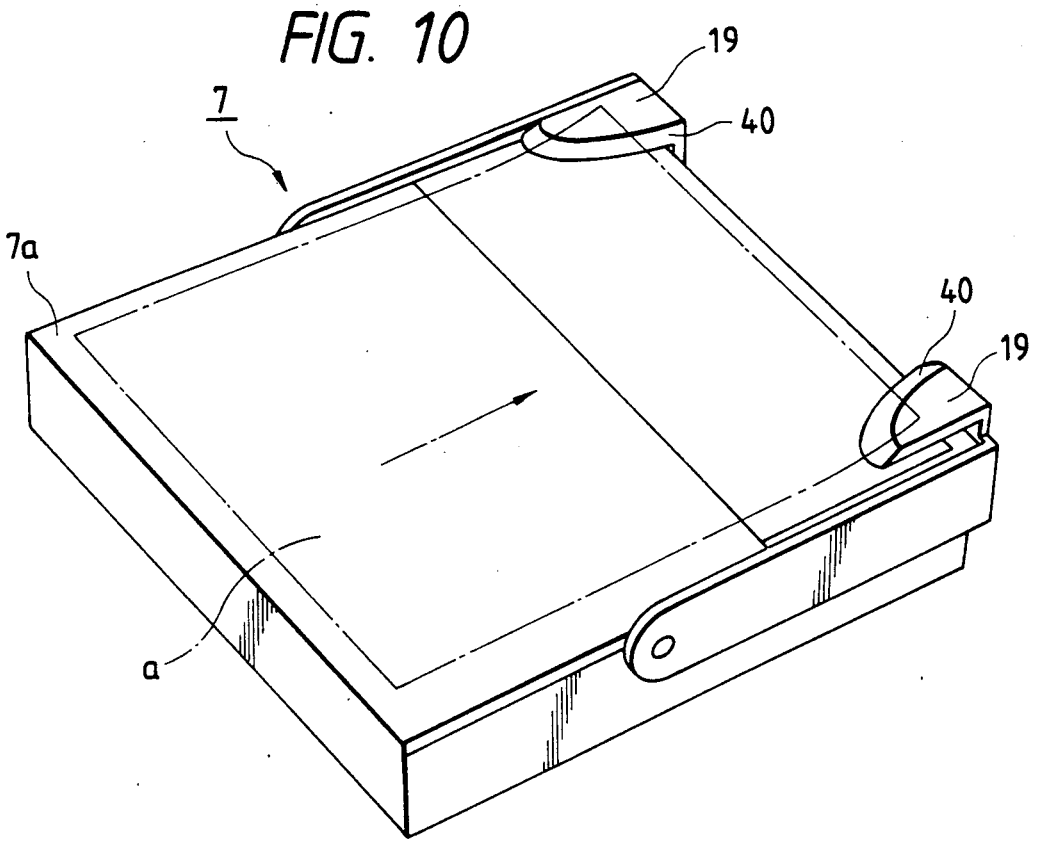

Another aspect of the invention is shown in FIG. 9, which shows a conceptual perspective of the paper cassette 7 on a magnified scale. The picture image former 30, which uses the upper area of the paper cassette cover *7a* as a part of the paper reversing channel C, is provided with a gently inclined area 40 formed on the area around the separating claw 19. The paper a, which is indicated by the dotted line in FIG. 10, passes over the paper cassette cover *7a* and is guided smoothly to the upper area of the separating claw 19 along the inclined area 40 without running against the separating claw 19. Thus, the inclined area 40 prevents paper skews which occur when the paper a runs against the separating claw 19.

Figure 11:
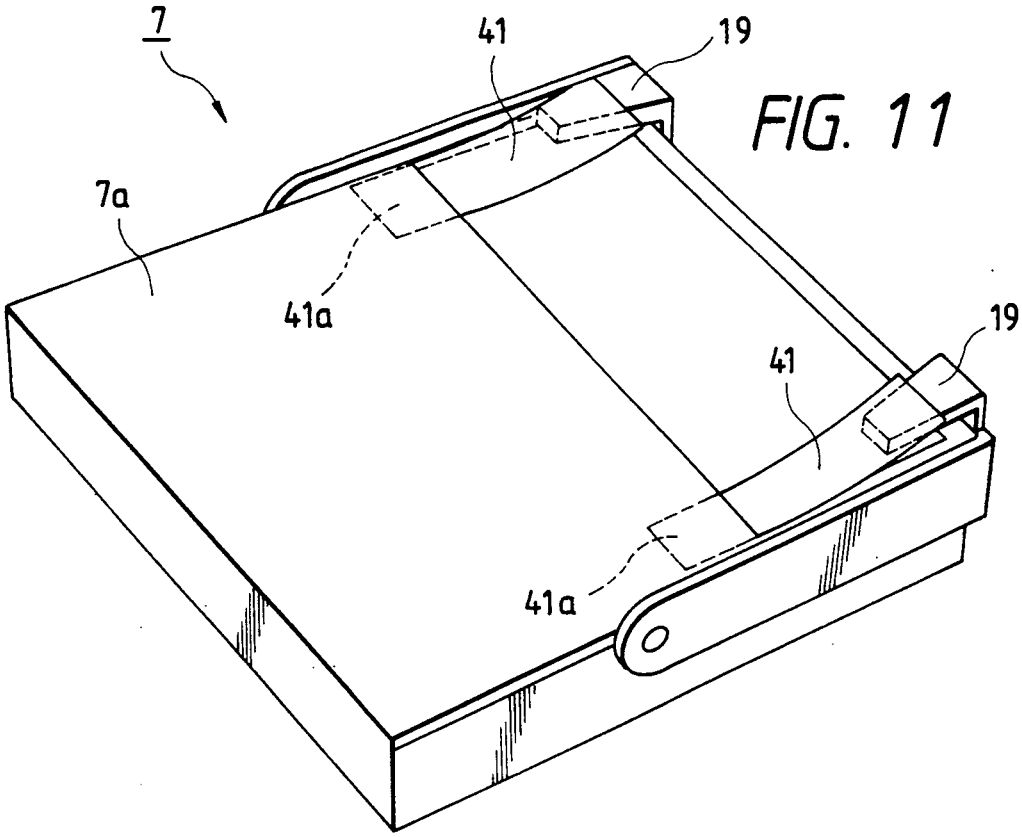
Figure 12:
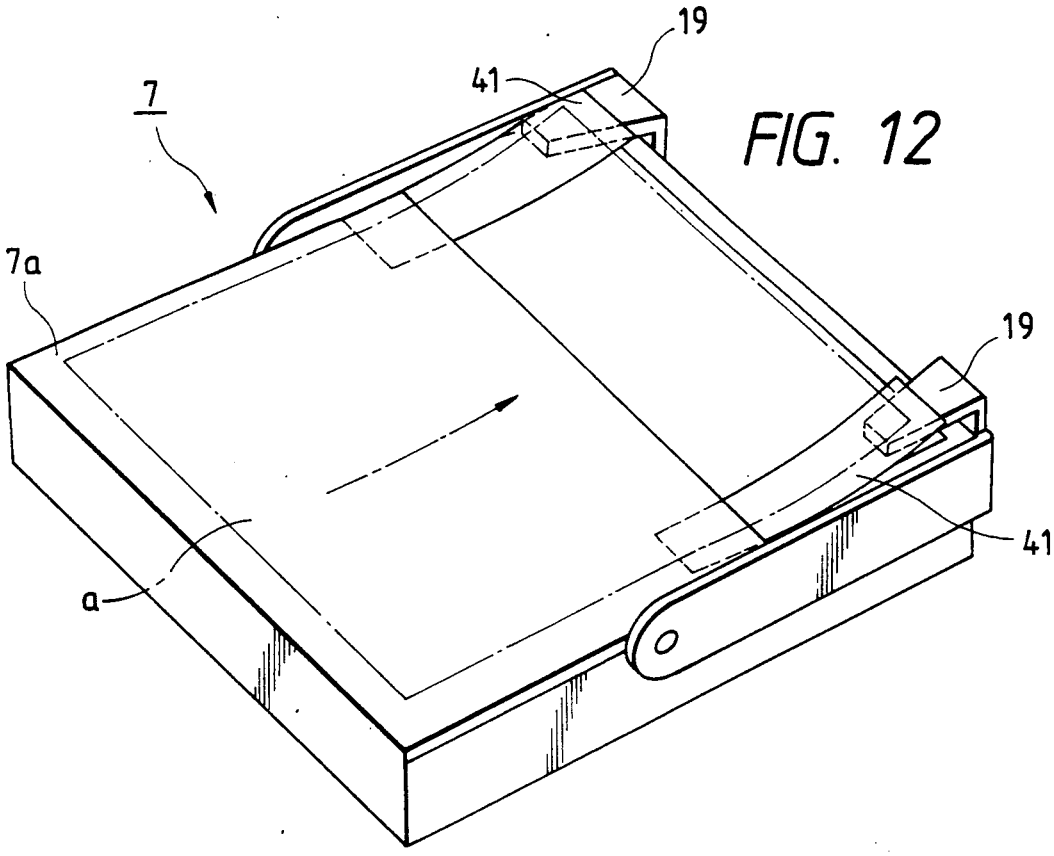

In the embodiment cited above, a gently inclined area 40 is used to guard the separating claw 19. Another embodiment of the guard is shown in the conceptual perspective view of the paper cassette 7 in FIG. 11. A sheet or strip 41 formed of a slippery material, such as Mylar, guards the separating claw 19 by covering the upper area of the separating claw 19. The rear end 41*a* of the strip 41 is inserted under the lower part of the cover *7a*. The paper a (indicated in a single-dot chain line) passes over the paper cassette cover *7a* which forms a part of the paper reversing channel C and is guided smoothly to the separating claw 19 along the strip 41 without running against the separating claw 19. Therefore, the strip 41 prevents paper skew caused when the paper a runs against the separating claw 19.

Figure 13:
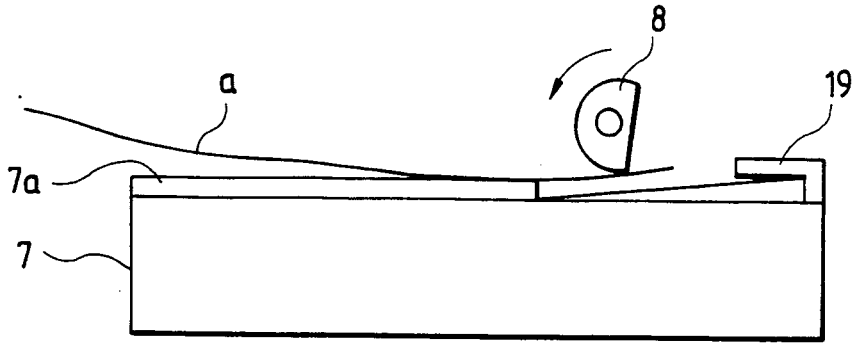
FIG. 13–17 illustrate, on a magnified scale, part of the equipment shown in FIG. 1.

Another aspect of the invention is shown in FIG. 13. Immediately before the paper a passes over the paper cassette cover *7a* which forms a part of the paper reversing channel C and runs against the separating claw 19, the feeding roller 8 is rotated nipping the paper a, to stop the paper a. Because force is only applied to the paper a in one direction by the feeding roller 8, the paper a will not be susceptible to skew. Even if the paper a is stopped by the feeding roller 8 rotated immediately before the paper a runs against the separating claw 19 and the paper a runs against the separating claw 19, and the feeding roller 8 rotates again, paper skew will not occur.

Figure 14:
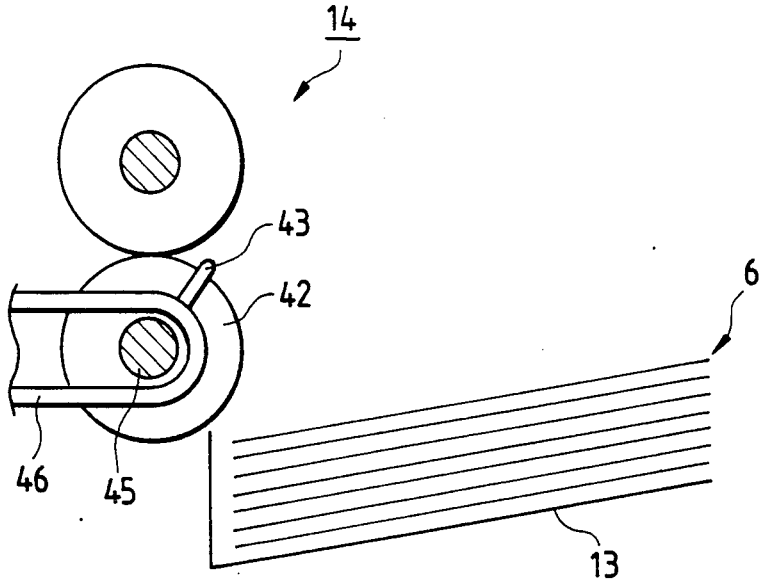
Figure 15:
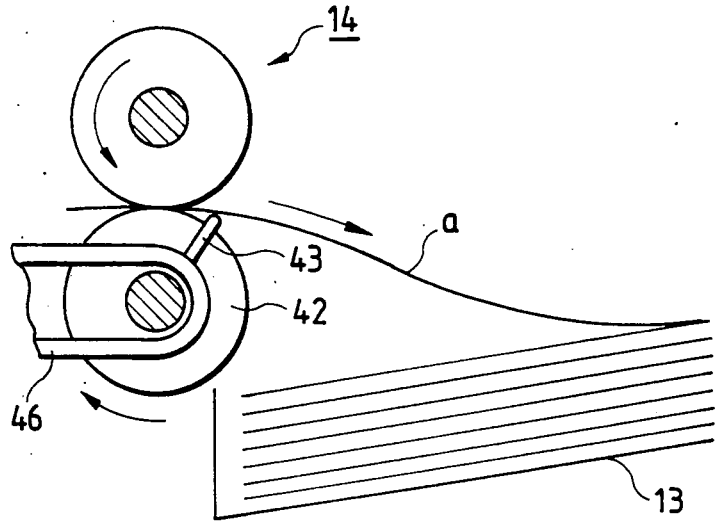

Another aspect of the invention is shown in FIG. 14. The picture image former 30 is provided with a claw 43 on the driving roller 42 of the discharging rollers 14 which rotate in the forward direction and in the reverse direction. The claw 43 protrudes from the circumferential area of the driving roller 43 and is inclined at a prescribed angle toward the side of the paper discharge tray 13. The claw 43 encloses a shaft 45 which supports the driving roller 42. The shaft 45 is fixed on a base 46 supported on the side of the main unit 2.

Figure 16:
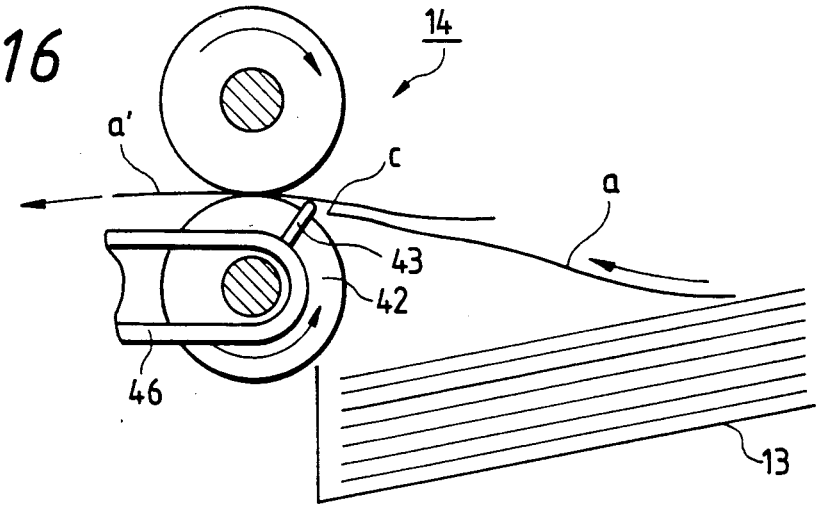

Referring to FIG. 16, the paper a is prevented from moving when its fore edge c comes into contact with the claw 43. Therefore, the paper a will not be pulled into the paper discharging roller 14. Even if the paper a sticks to the next sheet of paper a' and is pulled toward the side of the discharging roller 14 by the force of static electricity, the claw 43 will prevent a paper jam.

Figure 17:
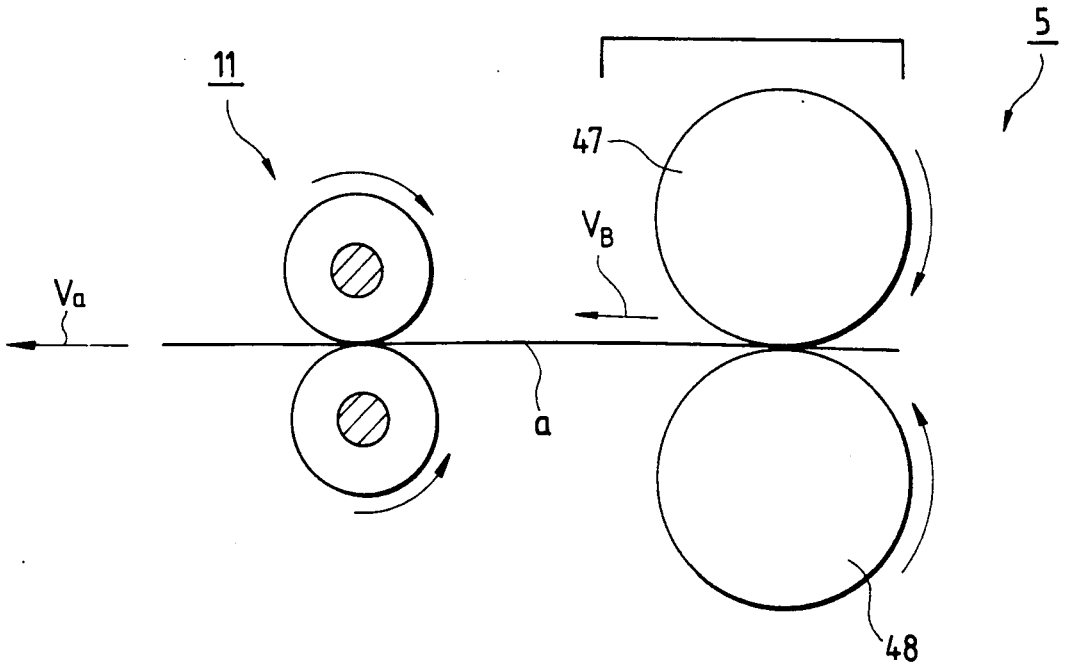

Another aspect of the invention will be described with reference to FIG. 17. A paper discharging roller 11 is arranged immediately behind the fixing unit 5 which is constructed with a heating roller 47 and pressure roller 48. The paper transporting velocity Va of the paper discharging roller 11 is higher than the paper transporting velocity Vb of the fixing unit 5 (i.e. $Va > Vb$). Consequently, a pulling force is constantly applied to the paper a discharged from the fixing unit 5, preventing paper skew as paper a is discharged from the fixing unit 5.

A gate controls the transporting direction of the paper and also works as an actuator for the sensor for detecting the presence or absence of the paper, the gate being installed at the point where the three paper transporting channels merge to form a connection. Therefore, it is not necessary to install an actuator for the paper detecting sensor as an independent component part, reducing the number of component parts.

A clutch is installed on the driving roller side of a pair of transporting rollers, which transport the paper to the feeding roller, so that the paper transported by the transporting rollers is stopped at the transporting rollers. The fore edge of the paper is thereby put into proper arrangement. Therefore, paper skew is corrected allowing the equipment to form images at an appropriate point on the paper.

A gentle inclined area is formed on the circumferential area of a separating claw provided on the paper cassette, so that the paper transported past the cover of the paper cassette to the separating claw is guided to the upper area of the separating claw along the inclined area. Therefore, the paper will not be susceptible to paper skew caused by the paper running against the separating claw.

A separating claw is set on the paper cassette, with a strip or sheet covering the separating claw. The paper moved past the cover of the paper cassette to the separating claw is guided to the upper area of the separating claw along the sheet. Therefore, the paper will not be susceptible to paper skew caused by the paper running against the separating claw.

The paper transported past the cover of the paper cassette to the separating claw is stopped once and held by the feeding roller before the paper runs against the separating claw. Therefore, when the paper is transported again with the feeding roller, paper skew is prevented even if the paper runs against the separating claw.

A discharging roller rotates in the forward direction and in the reverse direction with a claw protruding beyond the circumferential area of the discharging roller. Paper stacked in the paper discharge tray will not jam even if paper is pulled into the side of the discharging roller by the attracting force of static electricity of other sheets of paper in reverse movement. Therefore, paper jams are prevented.

The foregoing description of preferred embodiments of the invention has been presented for purposes of illustration and description. It is not intended to be exhaustive or to limit the invention to the precise form disclosed, and obviously many modifications and variations are possible in light of the above teachings or may be acquired from practice of the invention. The embodiments were chosen and described in order to best explain the principles of the invention and its practical application to thereby enable one skilled in the art to best utilize the invention in various embodiments and with various modifications as are suited to the particular use contemplated. It is intended that the scope of the invention be defined by the claims appended hereto.

What is claimed is:

1. A paper path for guiding and transporting a sheet of paper in an image former which forms an image on both sides of the sheet of paper, the paper path comprising:

an image forming channel having a first paper roller for transporting a sheet of paper past the image former;

a paper discharging channel connected at a first connecting point to the image forming channel and having a second paper roller arranged to rotate in a forward direction and a reverse direction for transporting a sheet of paper between the first connecting point and a discharge tray;

a paper reversing channel connected to the first connecting point and connected at a second connecting point to the image forming channel having a third roller for transporting a sheet of paper from the first connecting point to the second connecting point; and paper gate means at the first connecting point for guiding a sheet of paper at the first connecting point and for signaling the presence of the sheet of paper at the first connecting point.

2. A paper path as claimed in claim 1, wherein the gate means comprises:

a rotating shaft having first and second ends;

a first lever fixed on the first end of the rotating shaft, the first lever guiding the paper at the first connecting point;

a second lever fixed on the second end of the rotating shaft; and a switch operable by the second lever for signalling the presence of the paper.

3. A paper path as claimed in claim 2, wherein the paper gate means further comprises a spring attached to the second lever to normally bias the first lever in a position closing the image forming channel.

4. A paper path as claimed in claim 3, further comprising a fixing unit for fixing an image formed on the paper and a fourth roller for receiving the paper from the fixing unit, wherein the rotational velocity of the fourth roller is greater than the rotational velocity of the fixing unit.

5. A paper path for guiding and transporting a sheet of paper in an image former which forms an image on both sides of the sheet of paper, the paper path comprising:

an image forming channel having a first paper roller for transporting a sheet of paper past the image former;

a paper discharging channel connected at a first connecting point to the image forming channel and having a second paper roller arranged to rotate in a forward and a reverse direction for transporting a sheet of paper between the first connecting point and a discharge tray;

a paper reversing channel connected to the first connecting point and connected at a second connecting point to the image forming channel, the paper reversing channel comprising:

a third roller for transporting a sheet of paper form the first connecting point to the second connecting point; and clutch means connected to the third roller for selectively driving and stopping the third roller, wherein the clutch means stops the roller once while a sheet of paper is in the paper reversing channel.

6. A paper path as claimed in claim 5, further comprising a fixing unit for fixing an image formed on the paper and a fourth roller for receiving the paper from the fixing unit, wherein the rotational velocity of the fourth roller is greater than the rotational velocity of the fixing unit.

7. A paper path for guiding and transporting a sheet of paper in an image former which forms an image on both sides of the sheet of paper, the paper path comprising:

an image forming channel having a first paper roller for transporting a sheet of paper past the image former;

a paper discharging channel connected at a first connecting point to the image forming channel and having a second paper roller arranged to rotate in a forward and a reverse direction for transporting a sheet of paper between the first connecting point and a discharge tray;

a paper reversing channel connected to the first connecting point and connected at a second connecting point to the image forming channel, the paper reversing channel comprising:

a third roller for transporting a sheet of paper form the first connecting point to the second connecting point;

a paper tray containing paper having a top surface over which paper travels;

a claw on the paper tray for separating paper in the tray and paper traveling over the top surface of the tray; and guide means for guiding paper over the claw.

8. A paper path as claimed in claim 7, wherein the guide means is an inclined surface.

9. A paper path as claimed in claim 7, wherein the guide means is a strip covering the claw.

10. A paper path as claimed in claim 9, wherein the strip is formed of mylar.

11. A paper path as claimed in claim 10, further comprising a fixing unit for fixing an image formed on the paper and a fourth roller for receiving the paper from the fixing unit, wherein the rotational velocity of the fourth roller is greater than the rotational velocity of the fixing unit.

12. A paper path for guiding and transporting a sheet of paper in an image former which forms an image on both sides of the sheet of paper, the paper path comprising:

an image forming channel having a first paper roller for transporting a sheet of paper past the image former;

a paper discharging channel connected at a first connecting point to the image forming channel and having a second paper roller arranged to rotate in a forward and a reverse direction for transporting a sheet of paper between the first connecting point and a discharge tray;

a paper reversing channel connected to the first connecting point and connected at a second connecting point to the image forming channel, the paper reversing channel comprising:

a third roller for transporting a sheet of paper form the first connecting point to the second connecting point;

a paper tray containing paper having a top surface over which paper travels;

a claw on the paper tray for separating paper in the tray and paper traveling over the top surface of the paper tray; and stopping means for stopping paper traveling over the top surface of the paper tray.

13. A paper path as claimed in claim 12, wherein the stopping means is a fourth roller.

14. A paper path as claimed in claim 13, further comprising a fixing unit for fixing an image formed on the paper and a fifth roller for receiving the paper from the fixing unit, wherein the rotational velocity of the fifth roller is greater than the rotational velocity of the fixing unit.

15. A paper path for guiding and transporting a sheet of paper in an image former which forms an image on both sides of the sheet of paper, the paper path comprising:

an image forming channel having a first paper roller for transporting a sheet of paper past the image former;

a paper discharging channel connected at a first connecting point to the image forming channel and having a second paper roller arranged to rotate in a forward and a reverse direction for transporting a sheet of paper between the first connecting point and a discharge tray, the second roller having a claw fixed on the side of the second roller extending beyond the second roller; and a paper reversing channel connected to the first connecting point and connected at a second connecting point to the image forming channel comprising a third roller for transporting a sheet of paper form the first connecting point to the second connecting point.

16. A paper path as claimed in claim 15, further comprising a fixing unit for fixing an image formed on the paper and a fourth roller for receiving the paper from the fixing unit, wherein the rotational velocity of the fourth roller is greater than the rotational velocity of the fixing unit.

* * * * *

UNITED STATES PATENT AND TRADEMARK OFFICE

CERTIFICATE OF CORRECTION

PATENT NO. : 5,055,885

DATED : October 08, 1991

INVENTOR(S) : Shouji Yoshikado et al.

It is certified that error appears in the above-identified patent and that said Letters Patent is hereby corrected as shown below:

Claim 5, column 9, line 4, change "form" to --from--.

Claim 7, column 9, line 54, change "form" to --from--.

Claim 12, column 10, line 24, change "form" to --from--.

Claim 15, column 10, line 59, change "form" to --from--.

Signed and Sealed this

Twenty-fifth Day of May, 1993

*Attest:*

Michael K. Kirk

MICHAEL K. KIRK

*Attesting Officer*

*Acting Commissioner of Patents and Trademarks*